US010973326B2

(12) United States Patent
Ehrenleitner

(10) Patent No.: US 10,973,326 B2
(45) Date of Patent: Apr. 13, 2021

(54) SEATING FURNITURE

(71) Applicant: EB-invent GmbH, Altensteig-Walddorf (DE)

(72) Inventor: Franz Ehrenleitner, Altensteig-Walddorf (DE)

(73) Assignee: EB-INVENT GMBH

( * ) Notice: Subject to any disclaimer, the term of this patent is extended or adjusted under 35 U.S.C. 154(b) by 0 days.

(21) Appl. No.: 16/171,095

(22) Filed: Oct. 25, 2018

(65) Prior Publication Data

US 2019/0200763 A1 Jul. 4, 2019

(30) Foreign Application Priority Data

Oct. 25, 2017 (EP) ..... 17198337

(51) Int. Cl.

| | |
|---|---|
| ***A47C 7/14*** | (2006.01) |
| ***A47C 1/032*** | (2006.01) |
| ***A47C 7/02*** | (2006.01) |
| ***A47C 3/18*** | (2006.01) |
| ***A47C 3/30*** | (2006.01) |
| ***A47C 7/00*** | (2006.01) |

(52) U.S. Cl.

CPC ..... *A47C 1/03255* (2013.01); *A47C 3/18* (2013.01); *A47C 3/30* (2013.01); *A47C 7/004* (2013.01); *A47C 7/024* (2013.01); *A47C 7/14* (2013.01)

(58) Field of Classification Search

CPC .. A47C 7/14; A47C 7/004; A47C 3/18; A47C 1/03255; A47C 7/024

USPC ..... 297/300.1–300.8, 316, 317, 325, 326, 297/329, 344.1, 344.14, 344.15

See application file for complete search history.

(56) References Cited

U.S. PATENT DOCUMENTS

| | | | | |
|---|---|---|---|---|
| 4,547,017 A | 10/1985 | Lescure | | |
| 4,861,106 A | 8/1989 | Sondergeld | | |
| 5,009,466 A * | 4/1991 | Perry | A47C 3/023 297/323 | |
| 6,923,503 B2 * | 8/2005 | Sangiorgio | A47C 1/03255 297/300.3 | |
| 2003/0151288 A1 | 8/2003 | Deisig | | |

(Continued)

FOREIGN PATENT DOCUMENTS

| | | |
|---|---|---|
| DE | 10007103 A1 | 9/2001 |
| DE | 10007103 B4 | 9/2001 |
| DE | 10306851 A1 | 8/2004 |

(Continued)

*Primary Examiner* — Syed A Islam

(74) *Attorney, Agent, or Firm* — Raven Patents, LLC

(57) ABSTRACT

An item of seating furniture, in particular an office chair, having a pedestal with a support column on which a first rotational axis for a backrest is arranged which is pivotable between an upright starting position and a reclined resting position. The backrest is articulately connected in its lower region to a seat part, and when the seat part is in one piece, the articulatable connection is provided about a second axis. When the seating furniture is in the upright starting position, the second axis is arranged below the first axis. The rear seat part is non-rotatably connected to the backrest. The front seat part or the one-piece seat part is supported by kinematicsin relation to the carrying frame. The front seat part or the one-piece seat part is lowered relative to the rear seat part or the backrest by means of kinematics when the backrest is pivoted back.

11 Claims, 5 Drawing Sheets

(56) References Cited

U.S. PATENT DOCUMENTS

2006/0244294 A1 11/2006 Dozsa-Farkas

FOREIGN PATENT DOCUMENTS

| | | | |
|---|---|---|---|
| EP | 0296578 | B1 | 9/1993 |
| EP | 0559185 | A1 | 9/1993 |
| FR | 2527061 | A1 | 5/1982 |

* cited by examiner

SEATING FURNITURE

TECHNICAL FIELD

The invention relates to an item of seating furniture, in particular an office chair, corresponding to the preamble of Claim 1 and substantially to DE 103 06 851.

The invention relates to all kinds of seating furniture providing that they comprise at least one sitting surface and one backrest which is pivotable about a horizontal axis with reference to a base, in the majority of cases called a carrying part. In the case of an office chair, said base can be the uppermost part of a vertically adjustable column on a chassis, it can be a, where applicable, vertically adjustable pedestal which is fixedly mounted or rests in a freely displaceable manner on the floor, it can be a carrying part which is vertically adjustable and/or is displaceable in the longitudinal direction in a vehicle and so on and so forth. The explanation effected below by way of an office chair is not to be seen as a restriction.

BACKGROUND

The office chair disclosed in DE 103 06 851 is to allow the user to lean back particularly far and in this context discusses the actual stability of the chair and also the stability of the chair sensed by the user by a fixed, horizontal first pivot axis, which cuts the vertical axis of the pedestal, being provided for the backrest. A gas pressure spring or similar is provided in order to return to the starting position again.

EP 296 578 discloses an office chair where the back and the sitting surface are connected together by means of a joint with a horizontal transverse axis. Approximately in the central region of the sitting surface, said sitting surface is connected to the actual frame by means of a rotatable arm. Analogously to this, the backrest is connected to a rotatable second arm in the lower third at the same pivot point as the first arm. So that the four-bar linkage formed in this manner does not collapse, forced guidance in the manner of a step-up gear unit is provided.

EP 559 185 (no US publication) discloses an office chair where the back part is pivotable about a horizontal axis, which is adjustable with reference to the frame by means of a type of bracket, and the sitting surface about an axis which is also fastened to said bracket. Furthermore, the sitting surface is pivotable in its front region about an axis which is fixedly mounted on the frame and, when pivoting in cooperation with a spring, pivots the bracket and consequently the back at the same time. A flexible and compressible region which compensates for changes in spacing is provided between the seat and the back.

DE 100 07 103 discloses an office chair which is similar to the one treated beforehand. Instead of the bracket, however, the back and the seat are pivotally connected on the frame at axes which are adjustable with respect to one another such that the configuration of the back to the seat is determined by the determining of the axis arrangement.

FR 2 527 061 discloses an adjustable chair where the front part of the sitting surface is displaceable and pivotable with reference to a bolt in the border legs by means of a motion link, the rear part is pivotably connected to the back and the back is mounted above the rear legs so as to be rotatable on the frame.

U.S. Pat. No. 5,009,466 discloses an adjustable chair which, in side view, comprises a plurality of interconnected four-bar linkages which form a divided sitting surface, a divided back and the armrests. In this case, the armrests are mounted on the frame in an articulated manner or in an articulated manner by means of a cam with tension means and so as to be easily unrollable and the front part of the sitting surface is connected to the frame below the sitting surface by means of a tension means. In designs, the diverse hinge points are able to be adjusted and certain configurations can be predetermined by means of springs.

Said publications correspond, insofar as they exist, to US 2006/244294 A1, U.S. Pat. Nos. 4,861,106, 4,547,017 A, US 2003/151,288 A1 and to the named US one. The content of said publications is made the content of the present application by reference.

None of the named office chairs is capable of fulfilling the demands stated below even if only to a large extent.

SUMMARY

Many demands made on office chairs nowadays often contradict one another. It is thus desired, above all, that the office chairs are realized ergonomically and consequently also in a medically correct manner, that is to say allow for corresponding back support and movement possibilities for the user who often spends hours sitting on said chairs, even for inducing such movements. Apart from this, in numerous areas of application today the office chairs are no longer assigned to fixed users but the people working in each case take an office chair from a kind of pool for their working day, and it is desired here that as little time as possible to adapt the chair to the user is necessary. To this can be added some characteristics that up to now have been little observed which relate in part to comfort but in part also to ergonomics, thus, for example, that, with the chair tilting backward, there is an effect on the blouse of the female user or the shirt of the male user which makes it ride up and is caused by relative movements between user, sitting surface and backrest which have not been adapted correspondingly.

When the chair is reclined backward, in the majority of cases there is also an unpleasant, cutting-in effect on the underside of the front upper thigh areas, as a result of which blood circulation is impaired. This all results, once again, when pivoting backward, in the pivot angle being limited or not being fully utilized by the user, although both from the movement side and from use in resting periods a pivot angle of 30°, preferred 35° and particularly preferred 45° and more would be desirable. On top of all this is also the economic requirement that office chairs are to be producible in as cost-efficient a manner as possible, this excludes, for example, the use of special and sometimes highly accurate or even pre-tensioned bearings etc. and makes the use of gas pressure springs and similar difficult.

Consequently, there is a need for a chair, in particular an office chair, which comprises the named characteristics or fulfills the named requirements where possible completely and does so in the most cost-efficient manner possible.

The aim of the invention is to provide such an item of seating furniture, such a chair, in particular office chair.

According to the invention, said aims are achieved by a chair/office chair which comprises the features provided in the characteristics part of Claim 1. In other words, the seat part and the backrest are articulately connected to the carrying part by means of a first horizontal, transversely extending pivot axis, with the seat in the upright position, the starting position, said axis being situated in front of the backrest and above the sitting surface, in a preferred manner at least approximately in the region of the overall center of gravity of the movable parts of the user and of the movable parts of the chair, in the starting position, and a second pivot axis being provided parallel to said first pivot axis between the backrest and the seat part, said second pivot axis being arranged on the seat part in the starting position, when viewed from the first pivot axis, in a preferred manner within a range of no more than 5° in the direction toward the backrest and no more than 15° in the direction away from the backrest with reference to the vertical and below the sitting surface, in a preferred manner clearly below the sitting surface; and wherein, in addition, the sitting part is supported in its front third by means of kinematics by an arm which is connected to the pedestal or the carrying frame.

Said measure achieves a mobility of the backrest and of the sitting surface which makes the provision of a spring or of another energy storing means which makes a reaction force available during the reclining procedure superfluous, as the position of the overall center of gravity of the movable weights remains almost unchanged, which allows the user to move forward and backward in a pleasant manner on or with the chair.

In one variant it is provided to divide the seat part and consequently the sitting surface along an at least approximately vertically extending transverse plane into a front and a rear part which are restrictedly pivotable with respect to one another about a horizontal pivot axis. The rear part is permanently stationary with reference to the backrest, the front part carries out a corresponding translatory and rotating movement. The separation region, which can also be at a distance from the pivot axis, is arranged in a preferred manner such that a user rests with his ischium on the rear part and with the actual upper thigh on the front part. When the chair is set upright into the starting position, the front part is pivoted upward, consequently raised, with reference to the rear part by means of kinematics which are connected to the pedestal or the carrying frame.

The achievement of said measure is that the shirt-riding-up effect when reclining can be completely avoided. Furthermore, the effect of the blood being constricted is clearly reduced or even prevented as a result of the angular position that then occurs between the two seat parts.

BRIEF DESCRIPTION OF THE DRAWINGS

The invention will be explained in more detail below by way of the drawing with reference to office chairs, without being limited thereto, for the invention can also be applied to so-called "relaxing chairs", to "napping chairs", to television armchairs, to sunbeds, etc. In this case, the figures are as follows:

FIG. 4A showing the office chair in an upright position, and FIG. 4B showing the office chair partially reclined.

DETAILED DESCRIPTION

Figure 1:
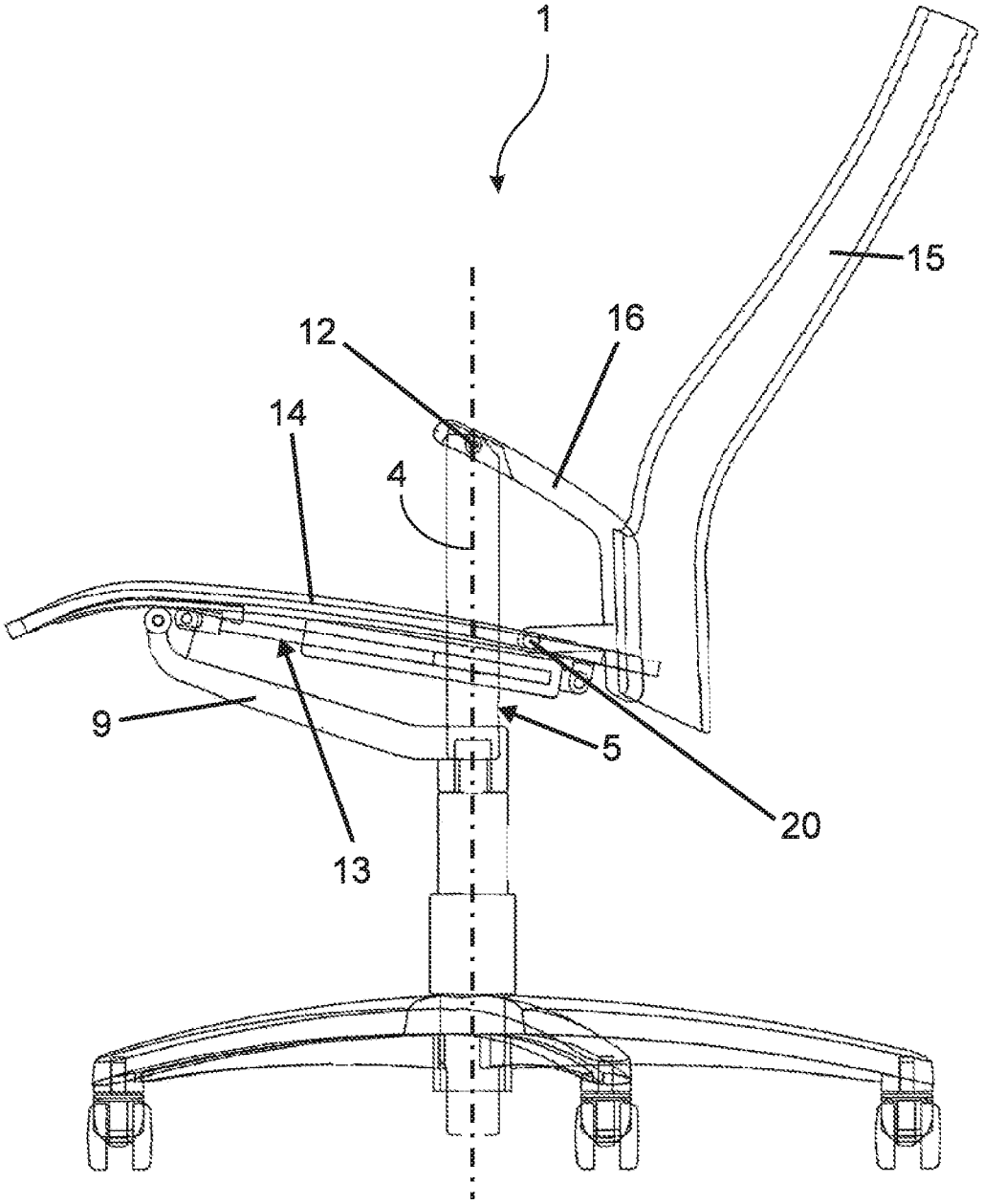
FIG. 1 shows an office chair corresponding to the prior art, namely to DE 103 06 851 named in the introduction.

FIG. 1 shows a purely schematic representation of the office chair 1 of the prior art in an already partially reclined position. The backrest 15 is pivotably mounted on a substantially U-shaped carrying frame 5 via a first rotational axis 12 by means of a pivot lever 16, which can also be realized as an armrest or carries such an armrest. In the lower region of the backrest 15 and a little in front of it, the backrest is pivotably connected to the seat part 14 via a second rotational axis 20. The seat part 14 is additionally guided by means of a sliding guide 18 and a corresponding roll on the end 10 of a support arm 9, which is connected to the carrying frame 5. An absolutely necessary return guide, the raising aid 13, in a preferred manner a spring or the like, is fastened by way of one end to the backrest 15, by way of the other end to the carrying arm 9 and is compressed when the backrest is reclined, consequently supporting the raising movement.

Said device, as mentioned in the introduction, bears the disadvantage that when the backrest is reclined, the shirt-riding-up effect occurs and that as a result of lowering the center of gravity of the moving parts, these being understood here as the corresponding body parts of the user and the movable parts of the chair, the raising aid 13 has to be provided.

In the case of a chair corresponding to said design, clear positioning of the second rotational axis 20 further forward would be seen as a first improvement according to the invention, as a result of which when the backrest is reclined, in the rearmost part of the seat part 14, that is the part which is adjacent the backrest 15, a raising or at least a clear reduction in the lowering is effected, which on the one hand makes the return guide 13, the spring, superfluous and on the other hand reduces the shirt-riding-up effect and, furthermore, improves the back support provided by the backrest. In this case, in order to obtain a certain initial resistance and consequently back support also in the resting position, the second rotational axis 20 can be positioned between the backrest and the sitting surface in the basic position just behind the first rotational axis 12; positions of up to 5°, possibly up to 15°, are possible between the vertical and the position of the axis, measured from the first rotational axis 12; a position forward through the first axis up to 15° in front of the vertical is also possible.

Figures 2, 3:
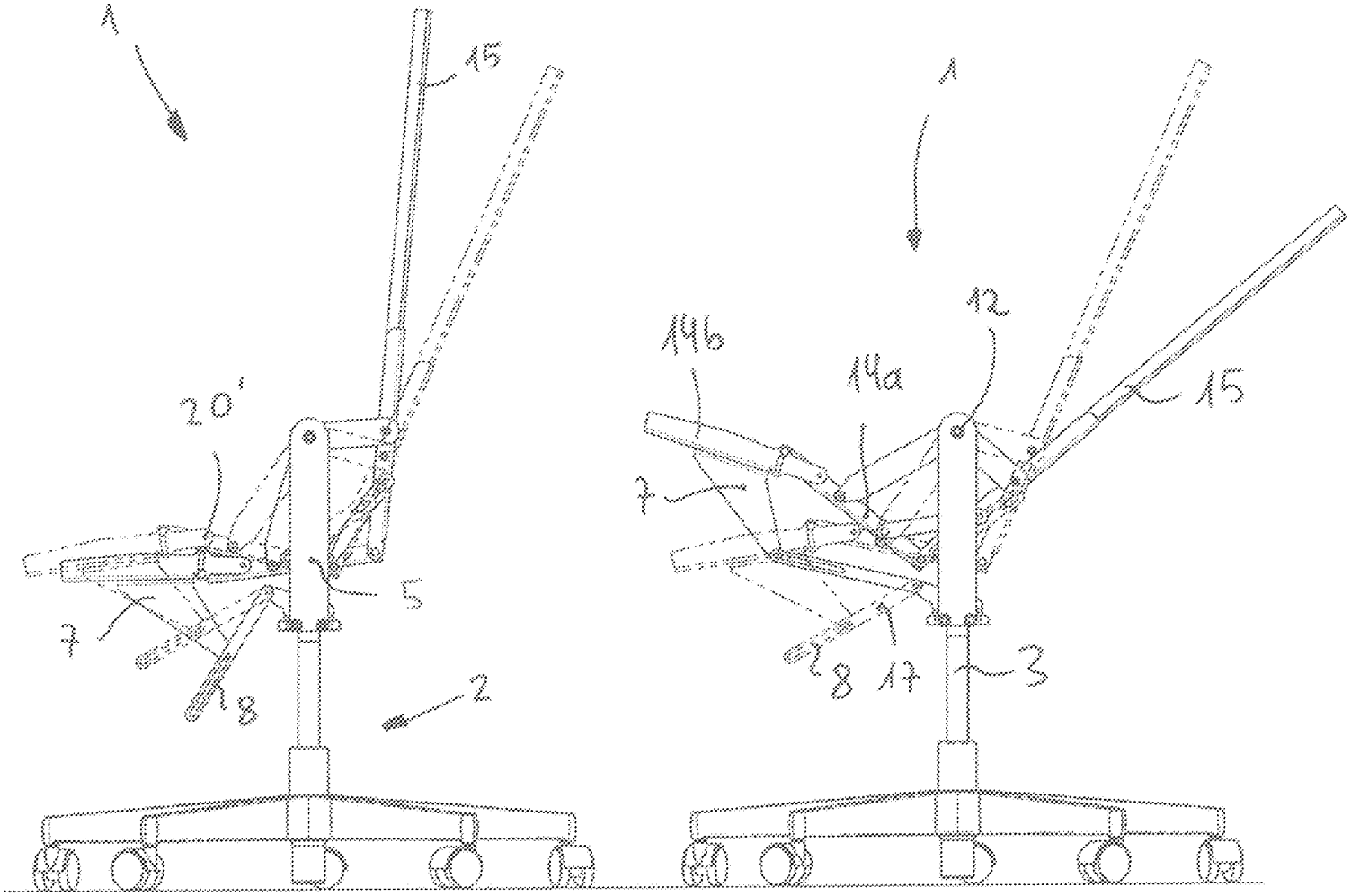
FIGS. 2 and 3 show the same view as FIG. 1 of an office chair according to the invention but at different positions of inclination.

As can be seen in FIGS. 2 and 3, an office chair 1 according to the invention in an embodiment with a divided sitting surface comprises the following features: a seat part 14*a*, which is fixed with reference to the backrest 15, and a movable seat part 14*b* which is pivotable about a second axis 20' with reference to the fixed seat part.

The fixed seat part 14*a* serves for supporting the ischium of the user such that when he/she reclines, no relative movement occurs in the back region and consequently no shirt-riding-up effect; the axis 20 disappears as a result, the axis 20' between the two seat parts has a totally different job and effect: When the backrest is reclined, the movable, front seat part 14*b* is pivoted downward such that the blood circulation in the upper thigh is not compressed in the knee area.

Figure 5:
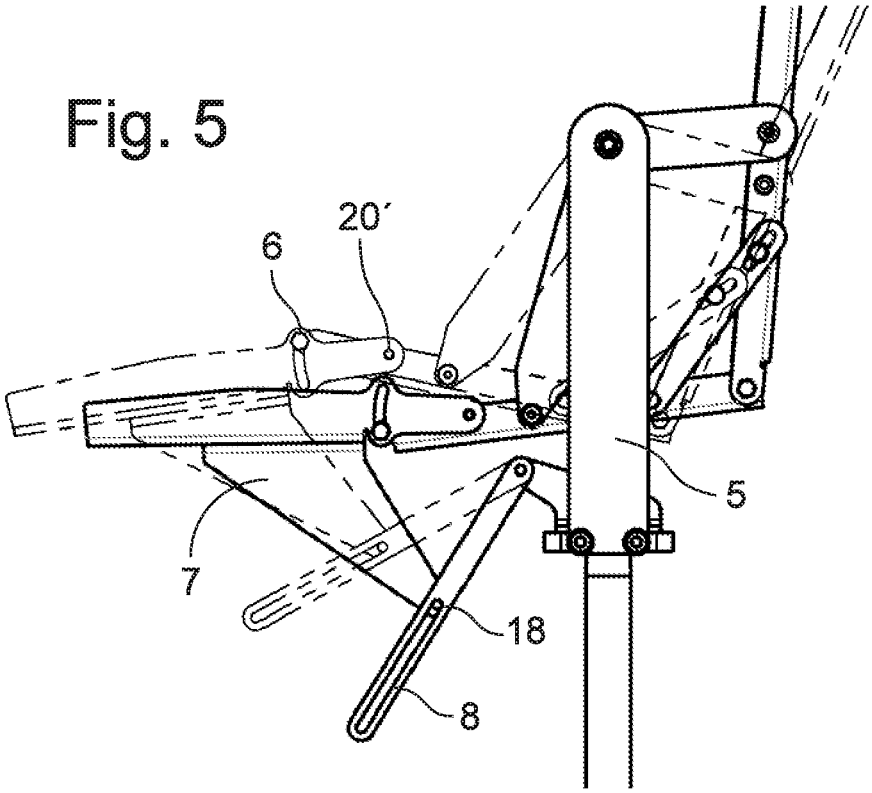
FIGS. 5 and 6 show enlargements of details from FIGS. 2 and 3 for better representation of the kinematics.
Figure 6:
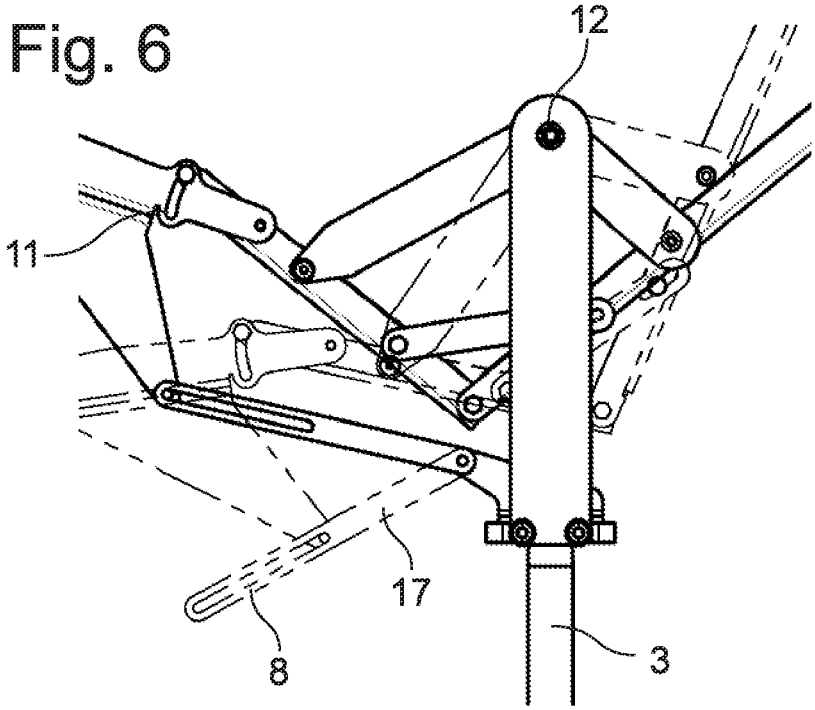

Kinematics that are perfectly usable for this are shown in FIGS. 2, 3, however especially in the enlarged representations in FIGS. 5 and 6: Non-rotatably connected to the movable front seat part 14*b* is a support part 7, which is guided in the region of its free end, which in said exemplary embodiment lies well below the sitting surface, by way of a roll 18 or the like in a longitudinal guide 8 of a pivot rod 17. The pivot rod 17, in turn, is pivotable about an axis on the carrying column 3 which is parallel to the axis 12. In the fully raised resting position, the pivot rod 17 assumes, on account of gravity, the lower end position which is shown with the solid line in FIG. 2 and is defined by stops or a bearing realization (not shown); the support part 7 acts on the pivot bar with a torque about the axis 20' in an anti-clockwise manner via the roll 18 or the like and the longitudinal guide (elongated hole) 8 and is held in the position shown as a result of the reaction force thereof. The end position of the two sitting parts with respect to one another and the boundary for the raising of the backrest 15 of the chair are defined as a result of interaction between a motion link 11 and a bolt 6, which is explained in more detail further below.

When the backrest is reclined, the position of the axis 20' in the rear sitting part 14*a* pivots clockwise about the axis 12, the front seat part 14*b* is rotated about the axis 20' until a bolt 6, which is provided fixedly on the rear sitting part in front of the axis 20', is moved in a motion link 11 in the rear region of the front seat part 14*b* from a lower end thereof to the upper end thereof; as a result of said movement, the front seat part is lowered in relation to the rear seat part, as a result of which the problems of blood constriction are eliminated. Once said situation has been achieved, as the backrest is inclined further, the front seat part (which then maintains its relative position in relation to the rear seat part) lifts the pivot bar 17 by means of the kinematics 7,8,18, the roll (or something similar) slides forward in the longitudinal guide 8 thereof until it reaches its highest possible angular position (FIG. 3, continuous line, resting position), which is provided either by the extended position but better by stops just before said highest angular position to avoid singularity. In said situation, the roll 18 abuts against the frontmost end (the bottommost in the upright position) of the longitudinal guide 8 and thus fixes the end position of the reclining action.

Figures 7, 8, 9:
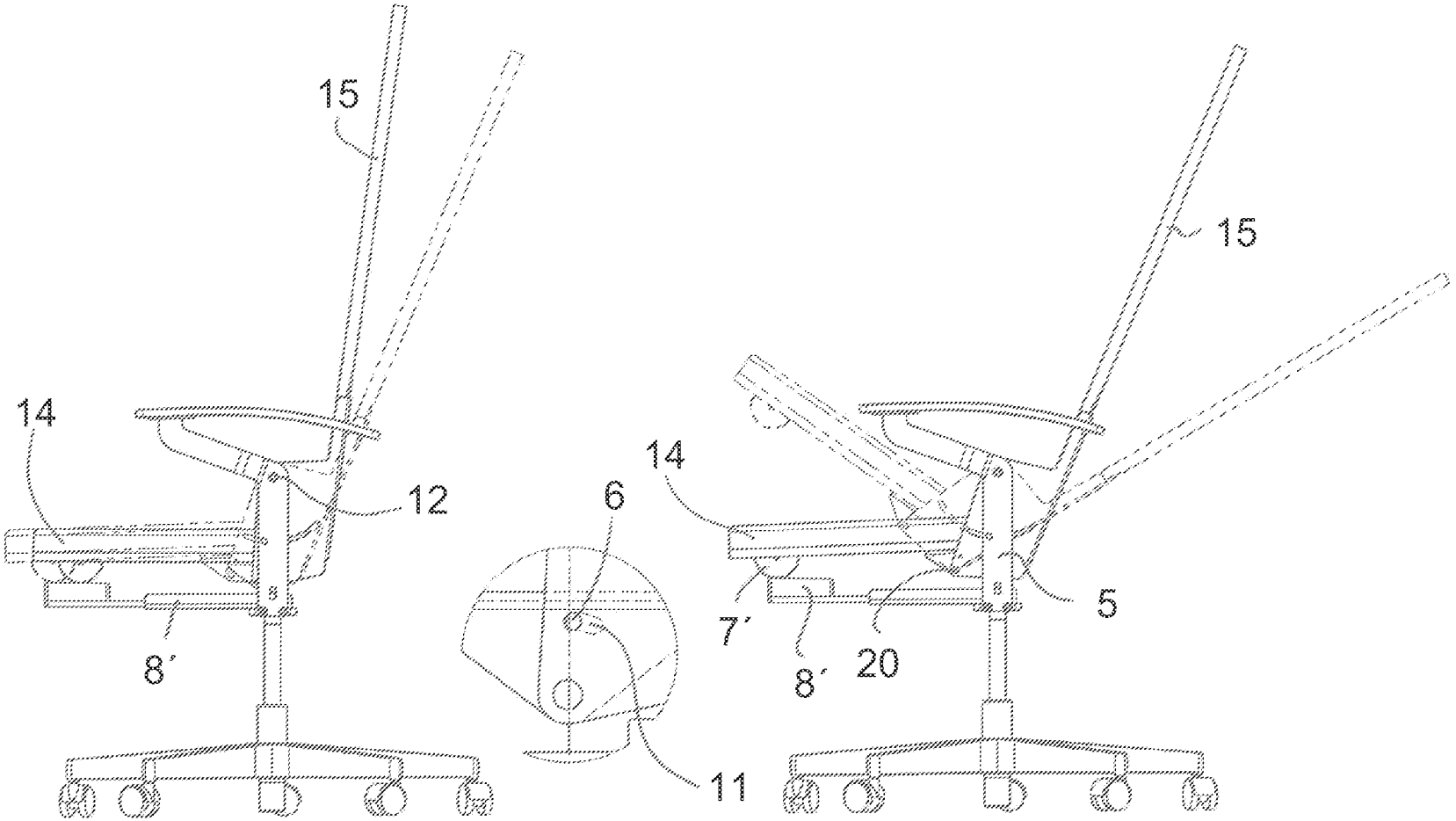
FIGS. 7 and 8 show a variant with a non-divided sitting surface and FIG. 9 shows a detail.

FIGS. 7 and 8 illustrate the variant of the invention with a non-divided sitting surface 14: The second axis 20 lies in the starting position, FIG. 7, solid lines, just in front of the vertical through the first axis 12, the non-divided sitting surface is provided in its front region with a roll 7' which rests on a support 8' which is fixedly connected to the carrying frame 5. When the backrest is reclined, the angle between backrest 15 and sitting surface 14 changes initially until, as a result of kinematics which are shown in FIG. 9, which shows this detail, a bolt 6 moves toward the end of a motion link 11 and, as a result when the backrest is inclined further, entrains the seat surface 14, as the situation in FIG. 8 shows with the dotted line. The support 8' does not have to be realized either in a straight-lined manner or connected non-rotatably to the carrying part 5; it can also comprise, like the versions according to FIGS. 2 and 3, a motion link instead of a support.

The realization of an armrest 19 as part of the carrying frame 5 is also easy to see on said representations, a flexible armrest, which is hinged on the carrying frame 5 so as to be pivotable and rests or is guided suitably on the backrest 15, is obviously also easily provided here too.

The motion link, which is not provided with a reference symbol, in the side region of the backrest, which interacts with a bolt or the like in the carrying part 5, defines the reclining action and consequently relieves the kinematics in the region of the sitting surface. Said arrangement can obviously also be used in the case of all other realizations.

The kinematics, which have been explained in the case of the two variants, in reality these are two kinematics which interact but are independent of one another, can be replaced by other ones, in particular in both cases the arrangement of guide and sliding part/roll part can be interchanged independently of one another; the longitudinal guide 8 does not need to be straight-lined, dampers can be provided at the ends of the guides and or at the sliding parts in order to avoid abrupt braking, the components ultimately defining the movement can be provided at another position, in particular on the carrying column 3, in order to relieve the kinematics of said forces/torque; and so on and so forth.

It is also possible to realize the transition between the two seat parts by means of an elastic component, similarly but naturally adapted, as in the case of transitions of vehicles, which also takes over the defining of the pivot movement of the components 6, 11 and, where applicable, is produced in one piece with the two seat parts.

It is up to the expert in the field of seating furniture production, in particular the production of chairs—office chairs to make an easy decision, cognizant of the invention, as to whether the kinematics 7,8,17,18; or 7',8' (or also the kinematics comprising the bolt 6 and the motion link 11) are doubled and are realized symmetrically at a distance from the central plane of the chair or are simply positioned in the plane of symmetry, even a simple eccentric arrangement is possible with corresponding solidity, if also only sensible in exceptional cases.

The designation "roll" on the one hand and "bolt" on the other must not be seen as technical differentiation but serves only for semantic differentiation, the inner functionality of the two kinematics with guiding and sliding part/roll part is certainly identical, just as the design possibilities thereof with sprung stops, rolls, "padded" rolls, the running surfaces of which are coated with rubber, polyurethane or a different elastomer.

The axes or joints described in the description and shown in the drawing can also be realized as so-called virtual axes, as is described, in particular, in WO2012/123102, WO2013/029069, DE 10 2012 002 402 or WO2016/042127, DE 10 2014 013 560 or also EP 2 686 145 of the applicant.

The components and functions associated with office chairs but not directly with the invention, such as the chassis, the vertical adjustability, the realization of the bearings for the individual axes, said term is used for both the respective bearings and the associated rotational axis, the design of the seat parts and of the backrest, the possibly provided armrests and much more, because they are well-established for the expert in the field of chairs—office chairs, and in order not to inflate them, will not be described in any more detail in the description.

As a result of the features according to the invention, it is possible, as explained above, to dispense with costly components, it is, however obviously possible to use or arrange them nevertheless. This applies, for example, to a raising aid, in particular when an extreme, end position of the reclining action is already provided in practice. At least the start of the raising procedure can then be supported from said position by means of a spring or similar.

An extendible leg support can be provided, by means of which, in the reclined end position or almost at that point, the legs are also supported in the lower thigh area and a recovery position is thus created. Said leg support can be extended or retracted by hand or by means of spring force, and/or can be fixed in different positions/in a stepless manner. It is also possible to be able to make the end region of the reclining action adjustable or to fix various intermediate steps.

It is possible to install in the backrest a lumbar support which is modifiable in a targeted manner by the user and so on and so forth; no more details on the armrests and the like have to be given in this context, only that they are connected in a suitable manner to the carrying frame 3. The carrying frame does not have to be realized in the mentioned U-shaped manner even if this is practical in the majority of cases.

Figure 4B:
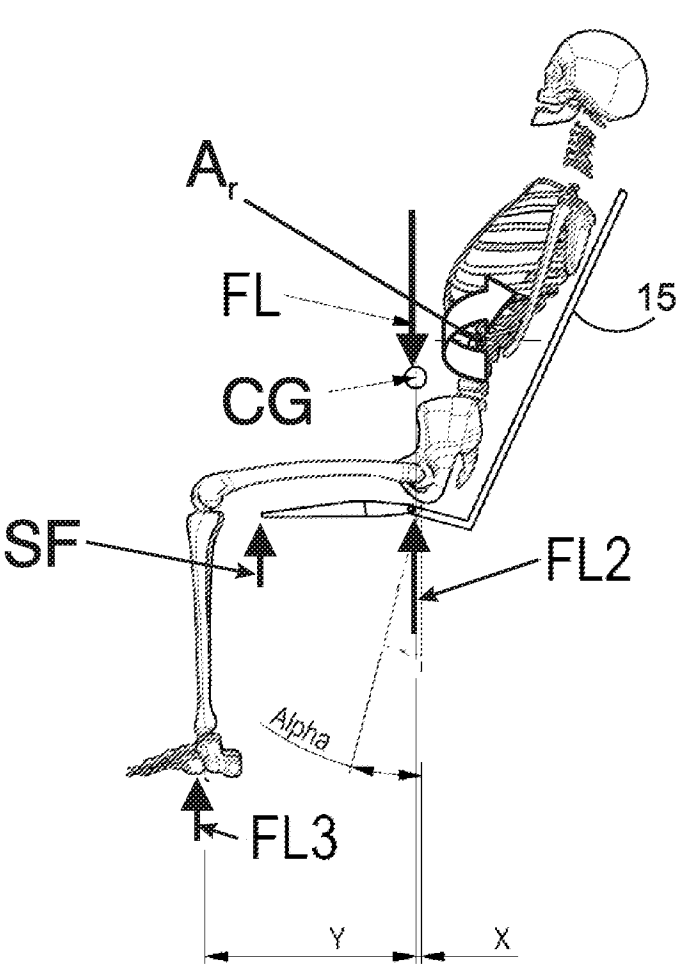
FIGS. 4A and 4B show two views of the dynamic foundations of an office chair according to the invention.
Figure 4A:
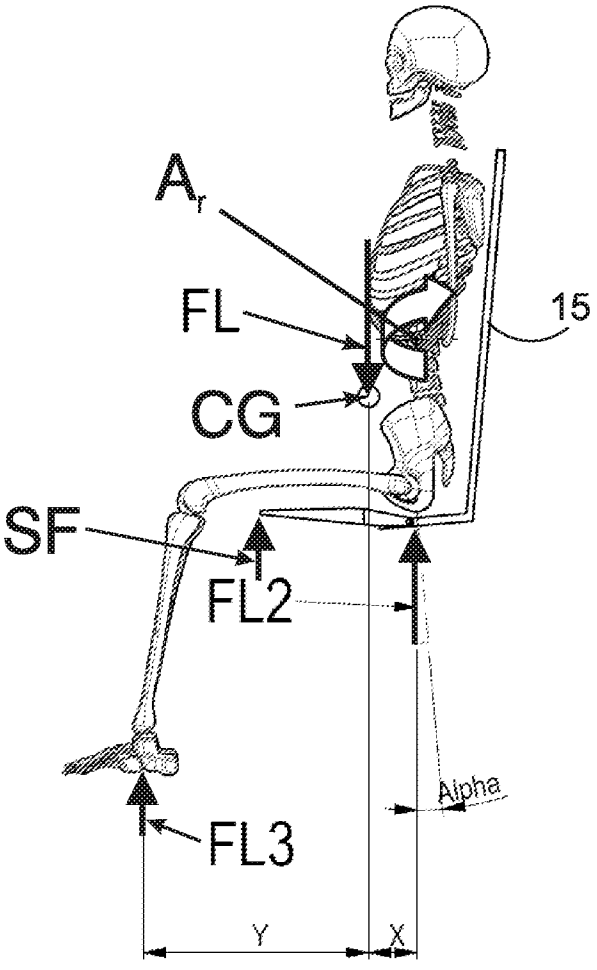

FIGS. 4A and 4B show in two representations, in FIG. 4A in the upright starting position, in FIG. 4B partially reclined, the forces occurring when an office chair realized according to the invention with a divided seat part is in use and consequently, when taking the movement into account, the change in the potential energy as a result of moving the height of the overall center of gravity of the moving parts of the user and of the moving parts of the chair. Fortunately, comfort of use is possible without energy storage means by means of the proportionality of the users, kept within wide limits, over wide ranges of size and of live weight, as a result of the positions of the axes provided according to the invention, such that savings are made, on the one hand, in costs during production and, on the other hand, in adjustment in use.

As can be seen in the representation of FIG. 4A, the rotational axis of the chair back $A_r$ in the starting position of the office chair is a little above and a little behind the center of gravity of the user CG, shown by way of his skeleton. In consideration of the body parts moved in different ways when reclining and of the chair parts moved at the same time, said two elements practically coincide. When reclining, shown in FIG. 4B, the center of gravity CG of the user moves practically above the center of the sitting contact surface (without upper thigh), just behind the division of the seat, the user experiences a raising counter force (counter torque) which makes the swaying and consequently the movement attractive. In this case, the center of gravity is not lifted or is only lifted slightly, in no circumstances is it lowered such that it is possible to dispense with a raising aid.

The normal on the rear sitting surface part is designated by way of "alpha", the angle of inclination can consequently be seen in the synopsis. FL is the downward force exerted by the user, FL2 is the upward support force provided by the seat, and FL3 is the upward force exerted by the foot rest, where FL2 and FL3 can be determined using the following equations:

$$FL2=(FL\times Y)/(Y+X)$$

$$FL3=(FL\times X)/(Y+X)$$

It should be pointed out again that in the description and the claims specifications such as "majority" in the composition of materials means in excess of 50% by weight, in a preferred manner in excess of 80% by weight and particularly preferred in excess of 95% by weight; that the "lower region" of a reactor, filters, structure, chair or of a device or, broadly speaking, of an object means the lower half and in particular the lower quarter of the overall height, the "bottommost region" means the bottommost quarter and in particular an even smaller part; whereas the "central region" means the middle third of the overall height. All these specifications have their general meaning, applied to the intended position of the object observed.

In the description and the claims, the terms "forward", "backward", "above", "below" and so on are used in their general form and with reference to the object in its usual position of use. This means that in the case of a chair/office chair, the sitting surface is the upper surface of the seat part, that the backrest is at the "back" of the chair, that the pedestal is "below", etc., etc.

In the description and the claims "substantially" means a deviation of up to 10% of the given value, if it is physically possible both downward and upward, otherwise only in the sensible direction, in the case of degree specifications (angle and temperature) the meaning is consequently ±10°. Designations such as: "clearly below the sitting surface" or the like designate regions of between 5 and 25 cm.

All quantity specifications, size specifications and proportion specifications, in particular such for delimiting the invention, insofar as they do not relate to the specific examples, are to be understood as having a tolerance of ±10%, consequently for example: 11% means: between 9.9% and 12.1%. In the case of designations such as for: "a seat part", the word "a" is not to be seen as a numeral but as a pronoun, if nothing to the contrary proceeds from the context.

The term: "combination" or "combinations", insofar as nothing to the contrary is provided, stands for all types of combinations, proceeding from two of the relevant component parts up to a plurality of such component parts, the term: "including" also stands for "consisting of" and vice versa.

The features and variants specified in the individual designs and examples can be freely combined with those of the other examples and designs and can be used, in particular, for characterizing the invention in the claims without forcibly entraining the other details of the respective design or of the respective example.

For opposition divisions, nullity divisions and appeal divisions in all jurisdictions, it is to be explicitly specified that the technical information included in the application and the drawings is combinable both individually on its own per se and in arbitrary combination for the expert in the field of the production of seating furniture, particularly of chairs, in particular of office chairs, without inventive step with all technical information in publications, whether patent literature or not, which fall into international class A47C.

In summary, it could also be stipulated: The invention relates to a chair, in particular an office chair 1, having a pedestal 2 with a carrier frame 5 on which a first horizontal rotational axis 12 is arranged for a backrest 15 which is pivotable between an upright starting position and a reclined resting position. The backrest 15 is articulately connected in its lower region to a seat part 14, when the seat part 14 is in one piece, the articulatable connection is provided about a second axis 20. According to the invention, with the chair 1 in the upright starting position, the second axis 20 is arranged below the first axis 12. The rear seat part 14*a* is non-rotatably connected to the backrest 15. The front seat part 14*b* or the one-piece seat part 14 is supported in relation to the carrying frame 5 by means of kinematics 7,8,17; 7',8'. The front seat part 14*b* or the one-piece seat part 14 is entrained lowered in relation to the rear seat part 14*a* or the backrest by means of kinematics 6, 11 when the backrest is pivoted back.

LIST OF REFERENCES

| | |
|---|---|
| 01 | Office chair |
| 02 | Pedestal |
| 03 | Support column |
| 04 | Vertical axis |
| 05 | Carrying frame |
| 06 | Bolt |
| 07 | Support part |
| 08 | Longitudinal guide |
| 09 | Carrying arm |
| 10 | Roll |
| 11 | Motion link |

-continued

| | |
|---|---|
| 12 | First rotational axis |
| 13 | Return device |
| 14 | (Non-divided) seat part |
| 14a | Fixed seat part |
| 14b | Movable seat part |
| 15 | Backrest |
| 16 | Pivot lever |
| 17 | Pivot bar |
| 18 | Roll |
| 19 | Armrest |
| 20 | Second rotational axis |

The invention claimed is:

1. An item of seating furniture, comprising:

a pedestal, including a support column which is rotatable about a vertical axis and having a vertically adjustable upper end, and further including a carrying frame coupled to the vertically adjustable upper end of the support column;

a backrest having a first horizontal rotational axis arranged on the carrying frame, where the backrest is pivotable around the first horizontal rotational axis between an upright starting position and a reclined resting position;

a seat part that includes a movable front seat part and a fixed rear seat part that is non-rotatably connected to the backrest;

wherein when the backrest is in the upright starting position a second rotational axis is arranged in a region below the first rotational axis, and the second rotational axis deviates from vertical by no more than 5° toward the backrest and no more than 15° away from the backrest; and the moveable front seat part is supported by the carrying frame via a kinematic mechanism, where the moveable front seat part is lowered relative to the rear seat part or the backrest by means of the kinematic mechanism when the backrest is pivoted backwards from its upright starting position.

2. The item of seating furniture of claim 1, wherein the item of seating furniture is an office chair.

3. The item of seating furniture of claim 1, wherein the first rotational axis intersects the vertical axis.

4. The item of seating furniture of claim 1, wherein the kinematic mechanism connects the moveable front seat part and the fixed rear seat part, and the kinematic mechanism includes a bolt on one of the two seat parts and a motion link guiding the bolt on the other seat part.

5. The item of seating furniture of claim 4, wherein the kinematic mechanism connecting the moveable front seat part and the fixed rear seat part includes an elastic component.

6. The item of seating furniture of claim 1, wherein the kinematic mechanism supporting the moveable front seat part includes a longitudinal guide and a roller that is guided by the longitudinal guide, provided that one of the longitudinal guide and the roller is part of a pivot lever that is pivotably fastened on the carrying frame, and the other of the longitudinal guide and the roller is part of a support part which is connected to the moveable front seat part.

7. The item of seating furniture of claim 1, wherein the first horizontal rotational axis lies between 5 cm and 15 cm in front of a leaning surface of the backrest.

8. The item of seating furniture of claim 1, wherein the first horizontal rotational axis lies between 15 cm and 25 cm above a sitting surface of the fixed rear seat part.

9. The item of seating furniture of claim 1, wherein when the item of seating furniture is in the upright starting position, the first horizontal rotational axis lies in a region that includes an overall center of gravity of a weight of a user, and the first horizontal rotational axis remains within the region during a transition to the reclined resting position.

10. The item of seating furniture of claim 9, wherein the region has a dimension of 10 cm in a horizontal and in a vertical direction.

11. The item of seating furniture of claim 9, wherein the region has a dimension of 5 cm in a horizontal and in a vertical direction.

* * * * *